US005913358A

United States Patent [19]

Chadwick

[11] Patent Number: 5,913,358

[45] Date of Patent: Jun. 22, 1999

[54] CASTING APPARATUS AND METHOD

[75] Inventor: Geoffrey Allan Chadwick, Winchester, United Kingdom

[73] Assignee: Hi-Tec Metals Ltd., Southampton, United Kingdom

[21] Appl. No.: 08/640,979

[22] PCT Filed: Nov. 9, 1994

[86] PCT No.: PCT/GB94/02457

§ 371 Date: Jun. 7, 1996

§ 102(e) Date: Jun. 7, 1996

[87] PCT Pub. No.: WO95/13157

PCT Pub. Date: May 18, 1995

[30] Foreign Application Priority Data

Nov. 11, 1993 [GB] United Kingdom ..... 9323248

[51] Int. Cl.[6] ..... B22D 18/04

[52] U.S. Cl. ..... 164/457; 164/119; 164/133; 164/155.3; 164/306; 164/312; 164/337; 266/239

[58] Field of Search ..... 164/119, 133, 164/306, 309, 312, 337, 457, 155.3; 222/595; 266/236, 239

[56] References Cited

U.S. PATENT DOCUMENTS

| | | | |
|---|---|---|---|
| 721,381 | 2/1903 | McAdams | 164/309 |
| 1,634,482 | 7/1927 | Youtsey | 164/119 |
| 1,672,728 | 6/1928 | Otis | 266/239 |
| 2,210,544 | 8/1940 | Galloway | 164/119 X |
| 3,861,457 | 1/1975 | Py | 164/457 X |
| 3,876,191 | 4/1975 | Lauersdorf | 222/595 X |
| 3,961,662 | 6/1976 | Balevski et al. | 164/457 |
| 4,741,381 | 5/1988 | Nishida et al. | 164/457 |
| 5,372,181 | 12/1994 | Watanabe et al. | 164/457 |

FOREIGN PATENT DOCUMENTS

| | | | |
|---|---|---|---|
| 4116998 | 11/1982 | Germany . | |
| 8915601 | 12/1990 | Germany . | |
| 59-73169 | 4/1984 | Japan | 164/457 |
| 62-81258 | 4/1987 | Japan | 164/457 |
| 2-89555 | 3/1990 | Japan | 164/306 |
| 2-169170 | 6/1990 | Japan | 164/155.3 |
| 3-258449 | 11/1991 | Japan | 164/337 |
| 213268 | 3/1968 | U.S.S.R. | 164/155.3 |
| 2103132 | 2/1983 | United Kingdom . | |

OTHER PUBLICATIONS

Hakkon Westengen et al., "Low Pressure Permanent Mould Casting of Magnesium–Recent Developments", Foundry Trade Journal, 163 (Oct. 6, 1989) No. 3399, pp. 738, 740, 742, Redhill, Surrey, GB.

Robert Lethen, "Automatisches Giessen aus Induktiv beheizten, druckluft–betatigten afen beim lumiumdruk–u-nd–kokillenguss," Giesserei, 58, Jahrgang, Dec. 16, 1971, Heft 25, pp. 769–775, Dusseldorf.

*Primary Examiner*—J. Reed Batten, Jr.

*Attorney, Agent, or Firm*—Beveridge, Degrandi Weilacher & Young, LLP

[57] ABSTRACT

The casting apparatus has a holding furnace for holding a reservoir of molten material, at least one smaller pumping furnace also for holding a reservoir of molten material and a casting cavity connected to the pumping furnace by one or more feed pipes. The pumping furnace is provided with a pressurizing assembly for applying a pressure to force the molten material from the pumping furnace into the casting cavity. The pumping furnace and holding furnace are contiguous and are connected by a non-return valve which prevents the flow of molten material from the pumping furnace to the holding furnace during pressurization but which allows the flow of molten material from the holding furnace to the pumping furnace after pressurization.

31 Claims, 6 Drawing Sheets

PRIOR ART

PRIOR ART

CASTING APPARATUS AND METHOD

The present invention relates to a casting apparatus and method, for use in low pressure casting in particular, and to provide metered quantities of metal for other casting processes, in general.

The majority of castings are now made by pouring liquid metal vertically under gravity in a turbulent fashion into moulds. The turbulence is often responsible for the majority of defects found in castings. The advantages of filling moulds in an upward direction in a non-turbulent manner have been known for a number of years and several systems have been devised which utilize this filling mode. However, such systems have not been popular because of their cost and general inflexibility for normal foundry use.

A typical casting apparatus which incorporates upward filling will usually comprise a large holding furnace from which the liquid metal is pumped either by an electromagnetic or pneumatic system.

For pneumatic systems, the large volume of gas which has to be pressurised renders such an apparatus slow in operation. Furthermore, the furnace has to be opened up frequently to recharge it with liquid metal, which causes an interruption to the casting cycle. The most usual form or this type or low pressure machine has three pressure regimes; first, a rapid pressure application to fill the riser tube or feeder tube; a second and lower rate of pressurisation to fill tile casting more slowly; and a final intensification pressure, commonly in the region of 4 bar, which is applied during the casting solidification stage. Although predominantly used with metal moulds, this pneumatic form of low pressure casting has also been used with plaster and sand mounds. Other types of pneumatic furnaces have been adapted to dispense a metered volume of liquid from the riser tube onto a launder for use in either gravity casting or high pressure die casting.

The alternative type of low pressure casting system using electromagnetic pumping units are expensive to install and costly to maintain since the electromagnetic pumps operate in an aggressive environment of liquid metal. Such low pressure pumping units do have one advantage over the conventional pneumatic furnaces in that the flow of metal through the electromagnetic pump is, in principle, easily controlled and can be electronically monitored in a fully computerised system. Electromagnetic pumping systems currently operate only in large holding furnaces for large runs of identical castings of constant alloy composition. Although it is sometimes claimed that they are intended for use in small foundries, such types of casting apparatus, being costly and inflexible in operation, are often unsuitable for use by jobbing foundries which constitute a large sector of the casting industry.

In order to overcome some of the special difficulties of both types of low pressure furnace, a casting apparatus was devised in which a small ceramic pressurising vessel, having a closable orifice in its lower region, was partially immersed in a reservoir of molten metal to effect replenishment of the pressurising chamber with metal after each casting operation. In such a way, only a small chamber is required to be pressurised to move metal upwardly into the mould cavity. However, the pneumatic apparatus described relied entirely on pressurisation by direct control of gas pressure through pressure gauges and/or pressure switches. Such a pneumatic control system is obviously limited in its range of operation by the number of independent pressure gauges and switches constituting the control assembly. Clearly, for complex metal flow profiles into complex casting cavities the hardware associated with such control assemblies becomes burdensome. Furthermore, the questionable mechanical stability of the ceramic crucible at the operating temperature and its possible limited lifespan due to thermal cracking, coupled with replacement costs of the crucibles used as the pressure vessel, create problems in selecting an economic crucible material. That is, whereas the refractory lined steel pressure vessel of a conventional low pressure casting furnace is thermally and mechanically robust, the independent ceramic pressure vessel partially submerged in liquid aluminum is prone to mechanical failure. Because of these inherent difficulties in the immersed pressure vessel concept, the process has never been put into practice.

There is thus a demand for a casting apparatus and method which will increase flexibility and productivity, which is compact, inexpensive and robust and which can upwardly cast or otherwise dispense variably small or large volumes of liquid metal.

The present invention overcomes the operational deficiencies of both the large conventional pressurisation furnaces and the small immersed pressurised vessel concept and provides a pneumatic furnace with the variable pressure ramping flexibility of an electromagnetic pumping furnace at a lower cost.

A casting apparatus comprising a holding furnace for holding a reservoir of molten material, at least one smaller pumping furnace also for holding a reservoir of molten material and a casting mould comprising a casting cavity connected to the pumping furnace by one or more feed pipes, the casting mould being located above the pumping furnace, and the pumping furnace being provided with means for applying a pressure to force the molten material from the pumping furnace into the casting cavity, wherein the pumping furnace and holding furnace are contiguous having a common wall within which a non-return valve means is located which prevents the flow of molten material from the pumping furnace to the holding furnace during pressurisation but which allows the flow of molten material from the holding furnace to the pumping furnace after pressurisation.

Clearly, the apparatus of the present invention is advantageous in that only a small volume of gas in the pumping furnace must be pressurised prior to causing the molten material to enter the casting cavity.

Preferably, the means for applying a pressure is continuously variable.

Preferably, the non-return valve means acts automatically.

The advantage of locating the pumping furnace contiguous with the holding furnace is that the apparatus is more compact and that molten material is not allowed to cool significantly between leaving the holding furnace and entering the pumping furnace. In addition, liquid metal erosion/corrosion within transfer pipes is obviated. Clearly, locating the non-return valve means in the common wall between the holding furnace and the pumping furnace ensures the most direct feed of molten material from the holding furnace.

Preferably, the non-return valve means is a ball and socket valve.

Preferably, the non-return valve means is a flap valve.

Preferably, the pumping furnace is constructed from refractory lined steel.

Preferably, the apparatus further comprises pressure control means for regulating the pressure within the pumping furnace.

Preferably, the pressure control means comprises an electrical controller, an energy to pressure converter, a pressure transducer and a pressure regulator.

Preferably, the apparatus further comprise a launder located between the feed pipe and the casting cavity wherein the casting cavity comprises the shot sleeve of a die casting or squeeze casting apparatus.

Preferably, the holding furnace can be opened to allow periodic filling with molten material.

Preferably, the apparatus comprises a plurality of pumping furnaces contiguous with the holding furnace.

In a further aspect, the present invention also provides a method of casting, comprising the steps of filling a holding furnace with molten material, transferring the molten material to a smaller contiguous pumping furnace, the holding furnace and pumping furnace having a common wall within which A non-return valve means is located, and pressuring the pumping furnace to force molten material from the pumping furnace up one or more feed pipes to a casting mould comprising a casting cavity, the casting mould being located above the pumping furnace.

Preferably, the non-return valve means acts automatically.

Preferably, the method further comprises the step of regulating the pressure within the pumping furnace.

Preferably, the method further comprises the step of transferring the molten material from the feed pipe to a launder prior to entering the casting cavity wherein the casting cavity comprises the shot sleeve of a die casting or squeeze casting apparatus.

Preferred embodiments of the present invention will now be described in detail, by way of example only, with reference to the accompanying drawings, of which:

FIGS. 1, 2, 3, and 4 are sketches of prior art casting apparatus;

Figure 1:
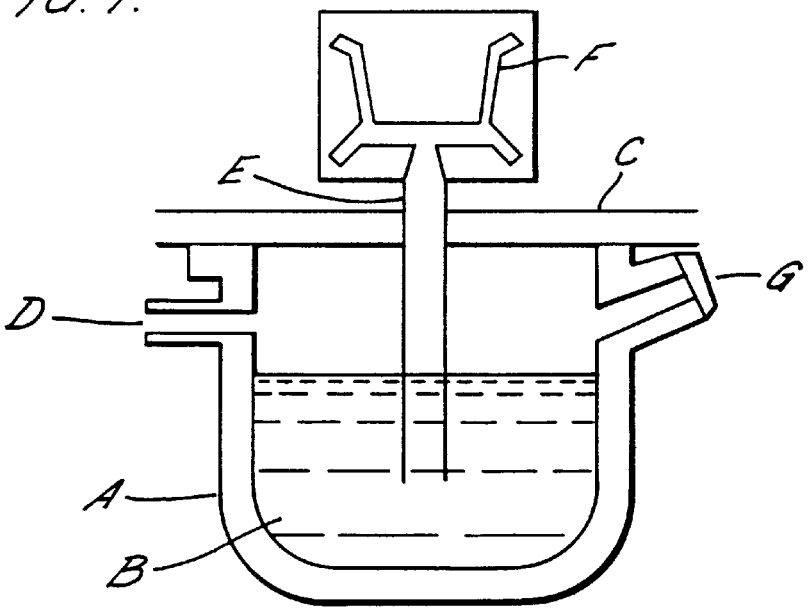

FIG. 1 depicts a typical upward filling casting apparatus according to the prior art. The casting apparatus comprises a large ceramic lined steel cased holding furnace A containing a reservoir of molten metal B. The holding furnace A has a pressure tight lid C. The holding furnace A is pressurised by introducing an inert gas or air through inlet D. The increasing pressure of gas above the molten material will force the molten material up a feeder tube E extending between the holding furnace A and the casting cavity F. Typically, the molten material b will be a liquid metal for use in casting an article such as a wheel or cylinder head. The holding furnace A will usually hold a mass of liquid metal of between 250–2000 kg. Clearly, the time required to pressurise such a large furnace volume can result in a slow casting process. The holding furnace A can be refilled via inlet C with further liquid metal.

Although the apparatus depicted in FIG. 1 provides the advantages of a low pressure upward filling casting process, it is well recognized that the pressurisation of a large holding furnace to dispense small quantities of liquid metal, coupled with intermittent shut-downs to recharge the furnace, is time consuming and suffers from poor control.

Figure 2:
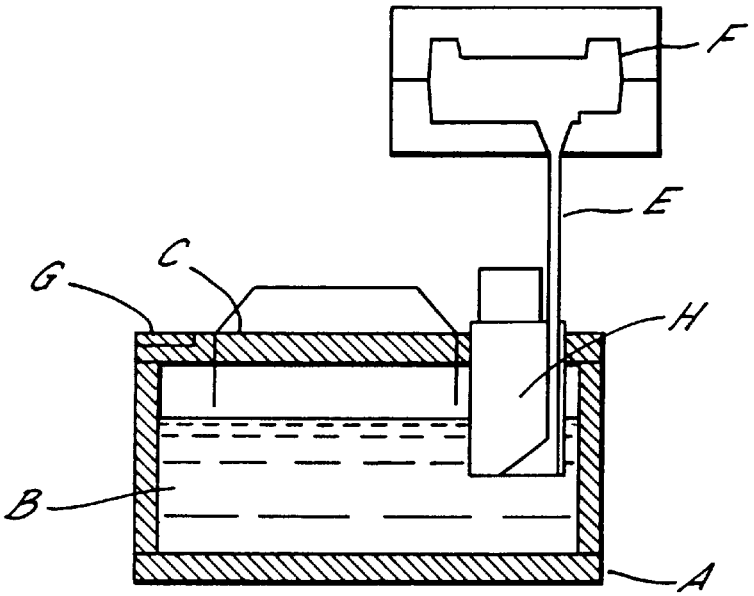
PRIOR ART FIG. 2.

FIG. 2 depicts an electromagnetic pumping system which comprises a large holding furnace A containing a reservoir of molten metal, for example, a liquid alloy B. The holding furnace A is fed with ingot material or liquid alloy at one end whilst at the other end an electromagnetic pump H is submerged in the molten material. Liquid metal is pumped upwardly through the feed tube E into the mould F by activating the power circuit of the electromagnetic pump H. The vastness of the furnace gives the opportunity for oxide particles to float or sink before they reach the pump H. However, the major disadvantages of this type of electromagnetic pumping system are that:

(a) the pumps are extremely expensive;

(b) they quickly deteriorate and fail in the liquid metal environment;

(c) pump performance may vary with time due to blockages; and (d) both metal overflow and diminished flow may occur sporadically due to occasional over-voltage fluctuations or sudden voltage ramping.

Figure 3:
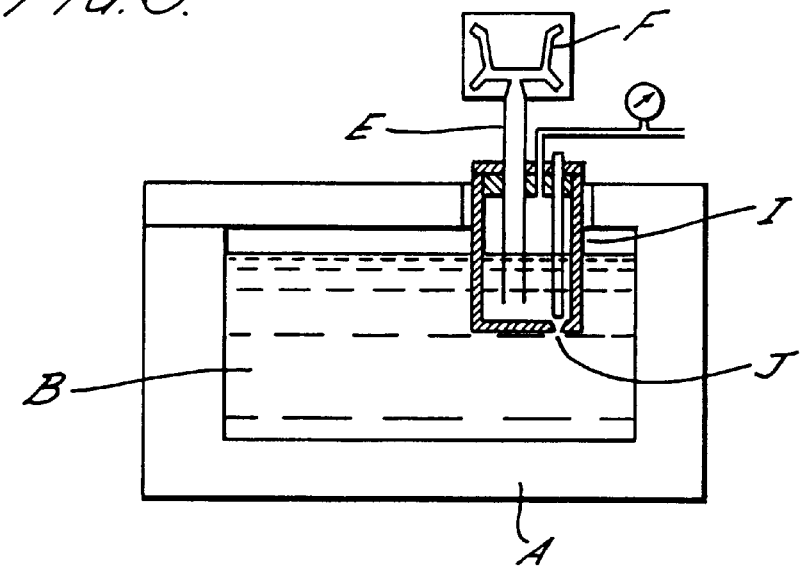

FIG. 3 shows the later concept devised to overcome the faults of conventional pneumatic systems and the electromagnetic system in which the electromagnetic pump H in FIG. 2 is replaced by pressurisable crucible I partially submerged in the molten material B. The crucible operates analoguously to the electromagnetic pump in FIG. 2 in that the crucible I is filled through a hole J in its base and passes liquid metal through itself and upwardly through the feed pipe E into the mould F. Due to the fragility of the crucible material and the difficulty of generating reproducible pressure regimes and of maintaining pressure tightness of the crucible lid, the system has never achieved commercial viability. The irresolvable difficulty of this concept is the lack of long-term rigidity and pressure tightness of the pumping unit because of the inevitable use of ceramic materials in its manufacture for use in a chemically aggressive liquid aluminium alloy environment.

Figure 4:
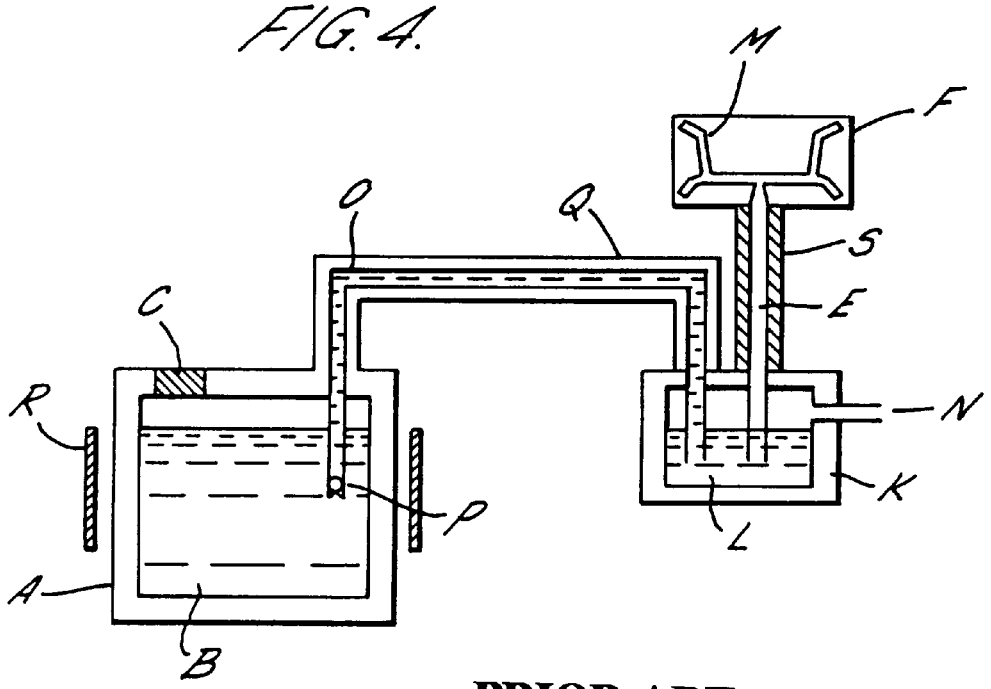
PRIOR ART FIG. 4.

FIG. 4 shows A further casting apparatus developed by the applicants. The casting apparatus comprises a holding furnace A constructed of steel plate and lined with refractory such as a calcium silicate board and containing a reservoir of molten metal B. There is a smaller pumping furnace K constructed in a like manner and also containing a reservoir of molten metal L. There is a mould F within which the molten metal is cast into a given article in casting cavity M. The pumping furnace K is provided with a gas inlet N which applies pressure to the interior of the pumping furnace K to force the molten metal through a feed pipe E into casting cavity M. The holding furnace A and the pumping furnace K are connected by a connecting tube O and molten metal will be eyphoned through the tube to pumping furnace K when the level of metal in pumping furnace K is below the level of metal in holding furnace A. A non-return valve P is located in tube O which ensures that there will be no reverse flow from the pumping furnace K to the holding furnace A when the pumping furnace K is pressurized. Tho pumping furnace K is sealed at its top with a pressure tight lid with gaskets, The non-return valve P will typically be a ball and socket valve which acts automatically to prevent reverse flow. When the holding furnace A is full, the head or molten metal exerts a force which displaces the ball from its seat and allows metal to enter the pumping furnace K. Once the difference between the levels in the holding furnace A and the pumping furnace K is small enough, the ball will return to its seat. Metal can be pumped up the feed pipe E by pressurising the pumping furnace K. For larger volumes of metal, a number of feed pipes can be used.

The connecting tube O needs to be insulated by means of a jacket Q to ensure that the molten metal does not cool when being transported to the pumping furnace K. The holding furnace A is provided with a removable lid C which enables refilling without interrupting the casting process being carried out in the pumping furnace.

Heating elements R and S are provided on the holding furnace A and the feed pipe E respectively to maintain the temperature of the molten material. The pumping furnace K can also be heated in a similar manner. However, although the term "furnace" is used when describing the pumping furnace K, it should be understood that the furnace is not necessarily heated but should be capable of being so.

If the apparatus in FIG. 4 is used in low pressure casting, the molten material will typically be an aluminium or magnesium alloy. The holding furnace K will hold approximately 250–2500 kg compared with approximately 10–50 kg held by the pumping furnace K. Clearly, there will be considerable saving of time and effort if only 10–50 kg of molten metal has to be pressurized at any given time to cast the article in moulding cavity M and if the process can be operated in an uninterrupted fashion as described above.

A disadvantage of the FIG. 4 embodiment is that the connecting tube O must be insulated and in addition, the tube O must be coated internally to prevent corrosion if liquid aluninium is used. The tube O will often be manufactured of steel and a great deal or effort has been spent in preventing liquid metal corrosion of the steel by coating the inside of the tube with different refractory coatings. It has proved difficult to find a coating which does not crack and spall (which leads to the aluminium interacting with the steel and the eventual (dissolution of the steel allowing leakage of aluminium).

It should be noted that if liquid magnesium is used, no such corrosion occurs so that all parts of the furnace can be of steel construction except the ball in the non-return valve P which is preferably made of a material of similar density to magnesium, such as lightly compacted silicon nitride, to facilitate the flow of magnesium into the pumping furnace.

Figure 5:
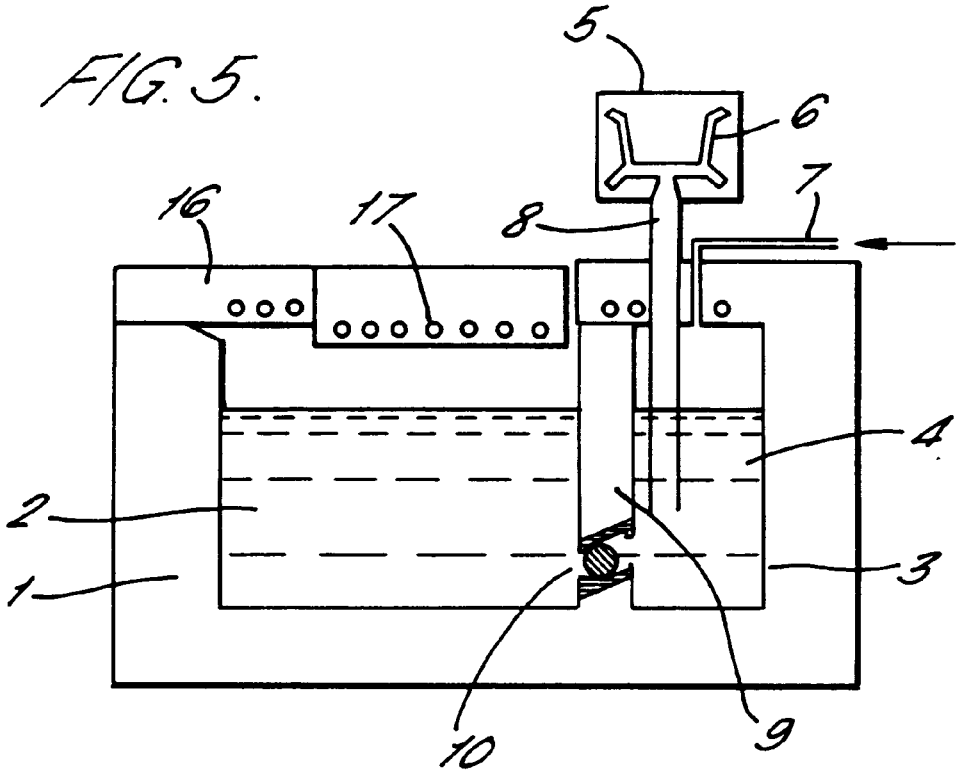
FIG. 5 is a first preferred embodiment of a casting apparatus according to the present invention.

FIG. 5 is a first preferred embodiment of a casting apparatus according to the present invention. The casting apparatus comprises a moulding furnace 1 containing a reservoir of molten metal 2 and a smaller contiguous pumping furnace 3 also containing a reservoir of molten metal 4. There is a casting mould 5 within which the molten metal is cast in casting cavity 6 into a given article. The pumping furnace 3 is provided with a gas inlet which applies pressure to the interior of the pumping furnace 3 to force the molten metal through a feed pipe 9 into casting cavity 6 or a launder (one embodiment being represented schematically by the box reference number 22 in FIG. 5A) for other casting apparatus. The holding furnace 1 and pumping furnace 3 have a common wall 9 within which a non-return valve 10 is located.

The non-return valve 10 is located in a passageway or orifice 11 in wall 9 and ensures that there will be no reverse flow from the pumping furnace 3 to the holding furnace 1 when the pumping furnace 3 is pressurised. The non-return valve 10 will typically be a ball and socket valve which acts automatically to prevent reverse flow. The non-return valve may be horizontal or at an angle to the horizontal.

Figure 6:
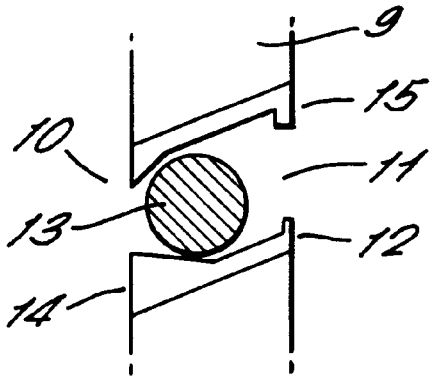
FIG. 6 is an enlarged view of the non-return valve in FIG. 5.

FIG. 6 shows detail of the non-return valve 10 located in the common wall 9. There is a passageway 11 having a ceramic sleeve 12 within which ball 13 can slide between a seat 14 and a stop 15 which limits the forward movement of the ball.

The holding furnace 1 is provided with a removable lid 16 which enables refilling without interrupting the casting process being carried out in pumping furnace 3.

Heating elements 17 can be provided on the holding furnace 1 and feed pipe 8 respectively to maintain the temperature of the molten material. Furthermore, the pumping furnace 3 could also be heated in a similar manner. By locating the non-return valve 10 in the common wall 9 between the holding furnace 1 and pumping furnace 3, the connecting tube O in FIG. 4 can be dispensed with so that the attendant problem of corrosion by liquid aluminium alloys and the necessity of lagging can be avoided.

The ball 13 will move against the seat 14 when pressure is applied to the pumping furnace 3 but will move away from the seat 14 to allow molten metal to pass from the holding furnace when the pressure in the pumping furnace 3 is released. Alternatively, a flap valve or any other similar non-return valve could be used in place of ball valve 10. A ceramic filter may also be placed at the inlet end of the ceramic sleeve 12 to allow only clean metal to enter pumping furnace 3 from molding furnace 1.

It will be appreciated that in the embodiment depicted in FIG. 5 the pumping furnace 3 must be made pressure tight to allow metal to he pumped upwardly from it through the feed tube O. Whereas the ball valve 10 or the flap valve will seal the passageway 11 during the pressurisation period, the top of the pumping furnace 3 is sealed by means of a pressure tight cover plate or lid with the option of an appropriate gasket between the mating surfaces.

In use, the apparatus shown in FIG. 5 will allow small volumes of molten material such as liquid metal in a casting process to be pumped uphill from the small pressurising furnace 3. Replenishment of liquid metal in pumping furnace 3 occurs due to the metallostatic head of the liquid metal in the large holding furnace 1 forcing liquid metal through valve 10 into pumping furnace 3 until the levels of liquid metal in holding furnace 1 and pumping furnace 3 are equal. Gas pressure will then be applied via gas inlet 7 to pressurise pumping furnace 3. For aluminium alloys, Compressed air would normally be applied to pumping furnace 3 although inert gas such as nitrogen or argon nay be used. For magnesium alloys, gas mixtures of air/sulphur hexafloride or carbon dioxide/sulphur hexafloride can be used. The non-return valve 10 will automatically prevent liquid metal from flowing back into the holding furnace 1 so that the liquid metal will only flow through the feed pipe 8 into the mould 5. After casting an article such as a wheel in casting cavity 6, the pneumatic pressure in the pumping furnace 3 will be released and more liquid metal will be introduced to furnace 3 for the next casting.

Figure 7:
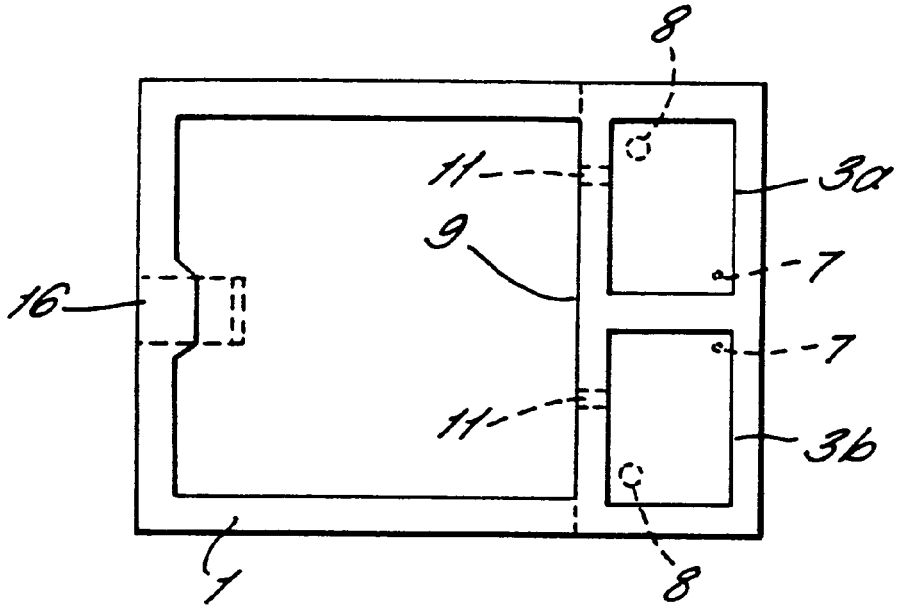
FIG. 7 is a second preferred embodiment of a casting apparatus according to the present invention.

FIG. 7 is a view from above of a further preferred embodiment where multiple pumping furnaces 3*a* and 2*b* are provided. The apparatus is similar to that in FIG. 5 where the pumping furnaces 3*a* and 3*b* are contiguous with the holding furnace 1 and each furnace is connected by an orifice or passageway 11 in a common wall 9 with its own non-return valve 10. Clearly, multiple pumping furnaces 3*a*, 3*b*, etc., will make the casting operation increasingly more economical. Each of the small pumping furnaces will be separately controlled using a pressure control system and independently operable. The multiple pumping furnaces 3*a*, 3*b*, etc., need not be of the same volumetric capacity, but if capacities vary, the cross sectional area or the orifices 11 may vary proportionately. The pumping furnaces may be situated in other positions, for example, at opposite ends of the holding furnace with the refilling port of the holding furnace located more centrally.

Figure 8:
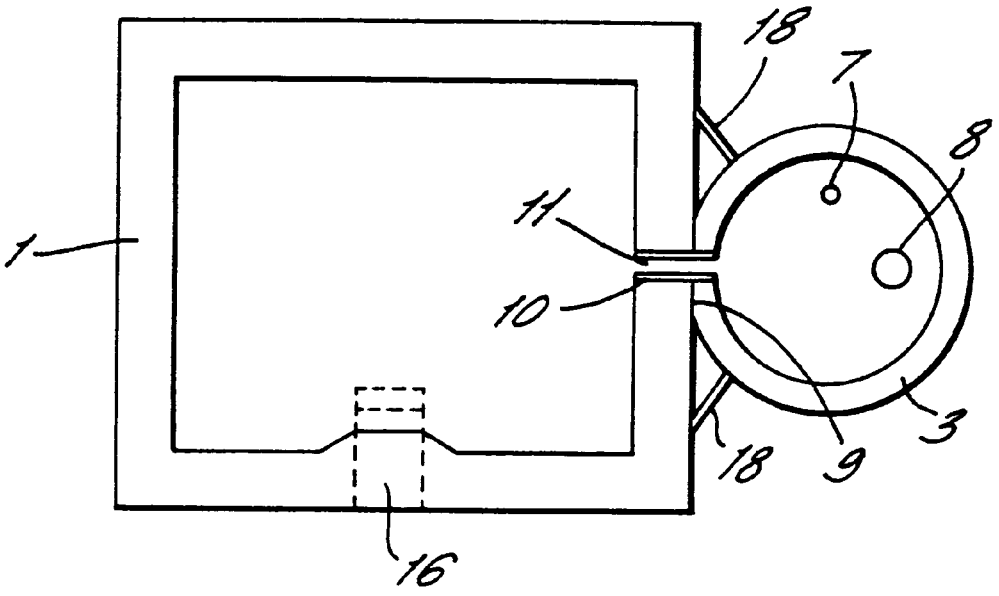
FIG. 8 is a third preferred embodiment of a casting apparatus according to the present invention.
Figure 9:
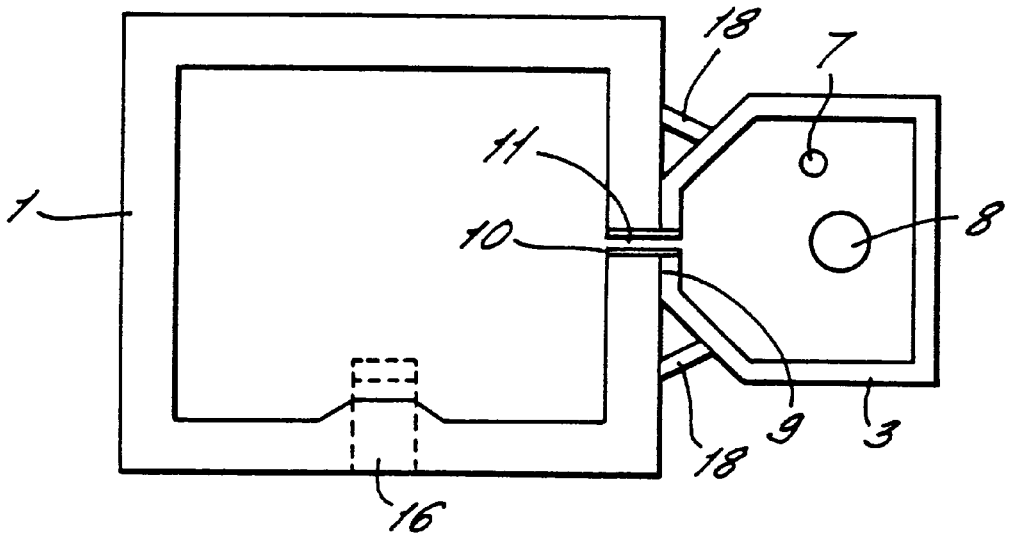
FIG. 9 is a fourth preferred embodiment of a casting apparatus according to the present invention.

Alternative constructional arrangements of holding and pressurising furnaces are possible in which the common wall or walls 9 of FIGS. 5 and 7 are diminished to smaller contact surfaces. FIG. 8 shows one such possible arrangement. In this embodiment, the pumping furnace 3 is constructed in roughly cylindrical form and is contiguous with the holding furnace 1 over a small area 9. In such an arrangement the pumping furnace 3 can be entirely or almost entirely surrounded by a steel outer casing. The pumping furnace 3 may be joined to the holding furnace 1 at a small contact surface through which is located the non-return valve 10 which may itself be supported in a ceramic sleeve. The contacting surfaces of the pumping furnace 3 and holding furnace may be made pressure tight by the inclusion of a suitable gasket or O-ring. With such an arrangement it is easy to make a pressure-tight seal between the steel-cased lid of the pumping furnace and the steel body of furnace during operation by use of gaskets. It is possible to secure the pumping furnace to the holding furnace either inseparably through welded supporting flanges 18 or separably through the use of bolts or matches or the like. Having a separable construction allows for the removal and refurbishment of one pumping furnace and valve assembly and its replacement by another, thus aiding flexibility of operation. Non-circular cross-sectional geometries of the pumping furnace 3 are alternatively possible and acceptable for contiguous positioning against the holding furnace 1 as shown in FIG. 9.

Figure 10:
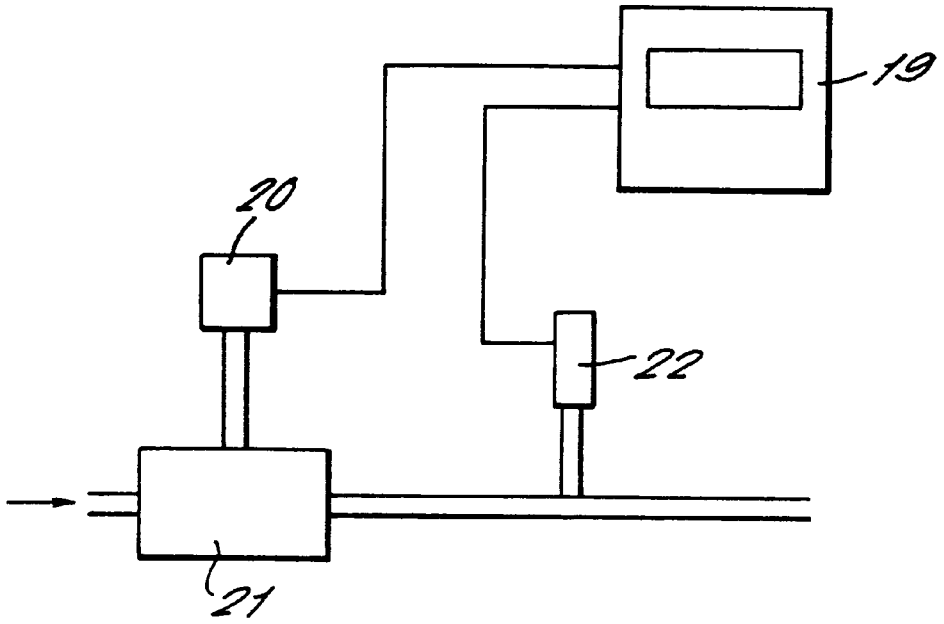
FIG. 10 depicts, a pressure control system for use with the apparatus in FIGS. 5, 7, 8 and 9.

A suitable pressure control system is depicted schematically in FIG. 10 and comprises an electrical controller 19, and energy to pressure converter 20, a pressure transducer 22 and a pressure regulator 21. The electrical controller 19 outputs a current profile within a given current range equivalent to the pressure profile required to pump liquid metal from the pumping furnace 3*a*, 3*b* etc. into the casting cavity 6 in a non-turbulent manner. The conversation from applied current to output pressure is performed by the energy to pressure convertor 20 which controls the output pressure and compares it with the pressure required by the electrical controller 19 according to its programmed pressure profile. The electrical controller 19 then reacts to this pressure signal.

Thus, the present invention is able to provide a low pressure upward-filling casting apparatus which will improve cast metal quality. It is already known that increasing the pressure on the liquid metal during casting decreases porosity in the cast product and that non-turbulent mould filling decreases the incidence of porosity as well as other defects such as oxide inclusions.

The apparatus of the present invention is useful for application to metal moulds and other ceramic moulds (e.g. plaster-of-paris, graphite, etc.). Light alloys are replacing iron and steel in automotive and general engineering applications so that there is an increasing demand for a high productivity, low pressure casting process for production or high quality, low scrap castings.

Figure 5A:
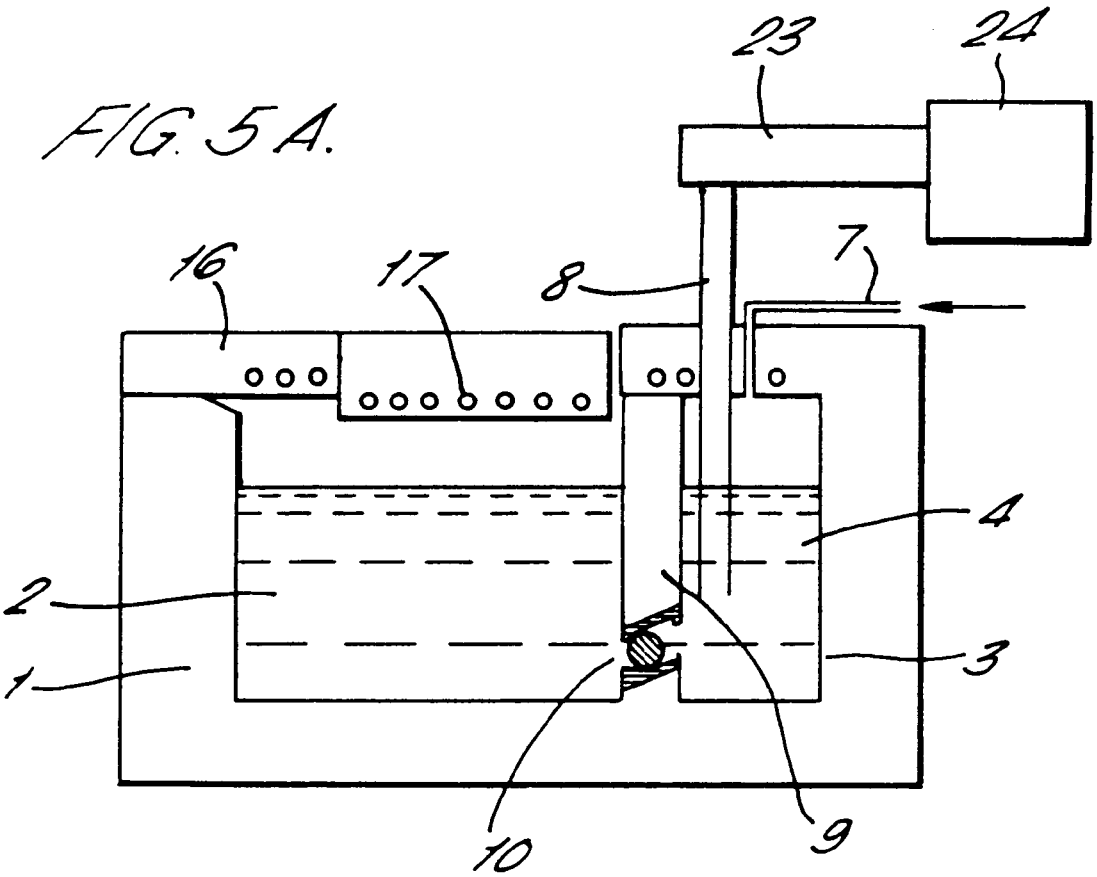
FIG. 5A shows a modification of the embodiment of FIG. 5 featuring a casting apparatus having a launder connected to shot sleeves (or casting cavities).

The casting apparatus of the present invention can also be adapted to work with high pressure die casting or squeeze casting machines (or in other casting processes) to dispense metered amounts of liquid metal through a launder into shot sleeves (or casting cavities) with the launder being represented schematically by the referenced dash block 23 in FIG. 5A and the shot sleeves (or casting cavities) being referenced schematically by the referenced block 24 in FIG. 5A, in which cases, a simple pressure pulse is sufficient to displace the required quantity of metal from the pumping furnace.

What is claimed is:

1. A casting apparatus comprising a holding furnace for holding a reservoir of molten material, at least one smaller pumping furnace also for holding a reservoir of molten material and a casting mould comprising a casting cavity connected to the pumping furnace by one or more feed pipes, the casting mould being located above the pumping furnace, and the pumping furnace being provided with means for applying a pressure to force the molten material from the pumping furnace into the casting cavity, wherein the pumping furnace and holding furnace are contiguous having a common side wall within which a non-return ball and socket valve is located which prevents the flow of molten material from the pumping furnace past the contiguous wall to the holding furnace during pressurization but which allows the flow of molten material from the holding furnace to the pumping furnace after pressurization.

2. A casting apparatus as claimed in claim 1, wherein the means for applying a pressure is continuously variable.

3. A casting apparatus as claimed in claim 1, wherein the non-return ball and socket valve includes a ceramic sleeve inserted within an opening in said common side wall.

4. A casting apparatus as claimed in claim 1, wherein the non-return ball and socket valve includes a sleeve received within an opening in said contiguous wall which extends an in an oblique fashion with respect to a horizontal.

5. A casting apparatus as claimed in claim 1, wherein one of said holding furnace and pumping furnace features a curved or multi-sided wall section facing an opposite one of said holding furnace and pumping furnace with a portion of said curved or multi-sided wall section being in contact with said opposite one of said holding furnace and pumping furnace so as to provide a small contact area contiguous wall.

6. A casting apparatus as claimed in claim 1, wherein the pumping furnace is constructed from refractory lined steel and said non-return ball and socket valve includes a ceramic sleeve fixed within an opening in said common wall and extending obliquely with respect to a horizontal plane with a lower end of said sleeve opening into said pumping furnace.

7. A casting apparatus as claimed in claim 1, further comprising; pressure control means for regulating the pressure within the pumping furnace wherein said pressure applying means includes a gas pressurizing assembly opening into said pumping furnace and said casting apparatus further comprising pressure control means for regulating the pressure within the pumping furnace, and wherein the pressure control means comprises an electrical controller, an energy to pressure converter, a pressure transducer and a pressure regulator, and said electrical controller forward signals to an energy to pressure converter in communication with said pressure regulator such that said pressure regulator regulates the pressure provided by said pressure applying means, and said pressure transducer being positioned so as to sense pressure in said pressure applying means and to provide said electrical controller with signals as to the sensed pressure.

8. A casting apparatus as claimed in claim 7, wherein said pressure control means continuously varies said pressure applying means so as to correct any deviations in said pressure applying means from a predetermined pressure profile in said electrical controller which deviations are sensed by said pressure transducer.

9. A casting apparatus as claimed in claim 1, further comprising a launder located between the feed pipe and the casting cavity wherein the casting cavity comprises a shot sleeve of a die casting or squeeze casting apparatus.

10. A casting apparatus as claimed in claim 1, wherein each of said pumping furnace and holding furnace have an access opening and closure, and the access opening in said holding furnace provides means for periodic filling of said holding furnace with molten material without disturbing or exposing molten material in said pumping furnace.

11. A casting apparatus as claimed in claim 1, comprising a plurality of pumping furnaces contiguous with the holding furnace and each pumping furnace being pressure tight and independently pressurizable by said pressure applying means.

12. A casting apparatus as claimed in claim 11, wherein at least one of said plurality of pumping furnaces has a different volume than a remaining other pumping furnace.

13. A casting apparatus as claimed in claim 12, wherein said at least one different volume furnace has a different sized flow through opening defined by said non-return ball and socket valve than the remaining other pumping furnace.

14. A casting apparatus as recited in claim 1, further comprising means for releasably attaching said pumping furnace to said holding furnace at said common wall such that a pumping furnace in an alternate state can be installed upon removal of said releasably attached pumping furnace.

15. A casting apparatus as recited in claim 14, further comprising a seal between said pumping furnace and said holding furnace to preclude leakage along releasable attachment points between said pumping and holding furnaces.

16. A method of casting, comprising the steps of filling a holding furnace with molten material, transferring the molten material to a smaller contiguous pumping furnace, the holding furnace and pumping furnace having a common wall within which a non-return valve means is located, and pressuring the pumping furnace with gas pressure applying means to force molten material from the pumping furnace up one or more feed pipes to a casting mould comprising a casting cavity, the casting mould being located above the pumping furnace, and the method including operating a pressure controller which senses pressure in the pressure applying means and adjusts pressure in the gas pressure applying means to provide a continuously variable flow rate function in the gas pressure applied by said gas pressure applying means; and wherein transferring the molt en material between furnaces includes passing the molten material through a ball and socket non-return valve arranged either horizontally or obliquely to a horizontal plane.

17. A method as claimed in claim 16, wherein the molten material is passed obliquely upward in travelling through said non-return valve means and said valve means acts automatically.

18. A method as claimed in claim 16, further comprising the step of passing molten material from said holding furnace to a plurality of pumping furnaces having non-return valve means controlled access to said holding furnace and regulating the pressure within said plurality of pumping furnaces which are independently sealed from each other and independently accessible without disrupting the sealed nature of another of said pumping furnace.

19. A method as claimed in claim 16, further comprising the step of transferring the molten material from the feed pipe to a launder prior to entering the casting cavity wherein the casting cavity comprises the shot sleeve of a die casting or squeeze casting apparatus.

20. A method as recited in claim 16, further comprising the step of releasing a releasable fastener joining said pumping furnace to said holding furnace, and detaching the released pumping furnace and installing another pumping furnace or a refilled pumping furnace thereafter.

21. A method as recited in claim 16, wherein said operating of said pressure controller includes adjusting pressure applied by said pressure applying means to conform to a preset pressure profile upon a sensed deviation from that pressure profile.

22. A method as recited in claim 16 wherein the passing of molten material involves passing the molten material through a plurality of different diameter non-return valves opening into different volume pumping furnaces from a common holding furnace, and independently pumping molten material from said pumping furnaces with said pressure applying means which is arranged to pressurize each of said pumping furnace independently.

23. A casting apparatus comprising a holding furnace for holding a reservoir of molten material, at least one smaller pumping furnace also for holding a reservoir of molten material and a casting mould comprising a casting cavity connected to the pumping furnace by one or more feed pipes, the casting mould being located above the pumping furnace, and the pumping furnace being provided with means for applying a pressure to force the molten material from the pumping furnace into the casting cavity, wherein the pumping furnace and holding furnace are contiguous having a common wall within which a non-return ball and socket valve is located which prevents the flow of molten material from the pumping furnace past the contiguous wall to the holding furnace during pressurization but which allows the flow of molten material from the holding furnace to the pumping furnace after pressurization, and said casting apparatus further comprising pressure control means for regulating the pressure within the pumping furnace in a continuously variable manner, said pressure control means including an electric controller in communication with both said pressure applying means and a pressure monitor monitoring a pressure state of said pressure applying means such that said controller provides a continuously variable flow rate function with respect to said pressure applying means and such that there is also provided a continuously variable flow rate capability in pumping molten material from said pumping furnace to the casting cavity.

24. A casting apparatus as recited in claim 23, wherein said pressure applying means includes a gas introduction assembly and said pressure control means includes a pressure regulator in line with said gas introduction assembly, and said controller being in communication with said pressure regulator via an energy to pressure converter communicating with both said controller and pressure regulator, and said pressure monitor comprising a pressure transducer in communication with a gas input line of said gas introduction assembly and said controller.

25. A casting apparatus as recited in claim 23, wherein a plurality of pumping furnaces are contiguous and in molten material communication with said holding furnace about one or more common walls, wherein said pressure controller is in communication with each of said pumping furnaces.

26. A casting apparatus as recited in claim 25 wherein said pumping furnaces are of a different volume.

27. A casting apparatus as recited in claim 23, wherein said pumping furnace is releasably attached to said holding furnace by way of releasable attachment means.

28. A casting apparatus as recited in claim 23, wherein said pressure controller adjusts the pressure supplied by said pressure applying means to conform to a predetermined pressure profile.

29. A casting apparatus comprising a holding furnace for holding a reservoir of molten material, at least one smaller pumping furnace also for holding a reservoir of molten material and a casting mould comprising a casting cavity connected to the pumping furnace by one or more feed pipes, the casting mould being located above the pumping furnace, and the pumping furnace being provided with means for applying a pressure to force the molten material from the pumping furnace into the casting cavity, wherein the pumping furnace and holding furnace are contiguous and have a common wall within which a non-return valve is located which prevents the flow of molten material from the pumping furnace past the contiguous wall to the holding furnace during pressurization but which allows the flow of molten material from the holding furnace to the pumping furnace after pressurization, and wherein one of said holding furnace and pumping furnace has a curved or multi-sided wall section facing an opposite one of said holding furnace and pumping furnace with a portion of said curved or multi-sided wall section in contact with the operable one of said holding furnace and pumping furnace so as to provide a small contact area contiguous wall; and wherein said non-return valve is a ball and socket non-return valve which is horizontally oriented or obliquely oriented with respect to a horizontal plane.

30. A casting apparatus as recited in claim 29 wherein said pumping furnace is releasably connected to said holding furnace by way of a releasable fastener.

31. A casting apparatus as recited in claim 29, further comprising pressure controlling means for varying said pressure applying means to provide a preset pressure profile in said pumping furnace.

* * * * *